US009668076B2

(12) United States Patent
Bidmead et al.

(10) Patent No.: US 9,668,076 B2
(45) Date of Patent: May 30, 2017

(54) MICROPHONE HEADSET FAILURE DETECTING AND REPORTING

(75) Inventors: Anthony P. Bidmead, Los Gatos, CA (US); Jahan C. Minoo, San Jose, CA (US)

(73) Assignee: Apple Inc., Cupertino, CA (US)

( * ) Notice: Subject to any disclaimer, the term of this patent is extended or adjusted under 35 U.S.C. 154(b) by 969 days.

(21) Appl. No.: 13/165,737

(22) Filed: Jun. 21, 2011

(65) Prior Publication Data

US 2012/0328116 A1 Dec. 27, 2012

(51) Int. Cl.

| | |
|---|---|
| ***H04R 29/00*** | (2006.01) |
| *H04R 3/00* | (2006.01) |
| *H04R 1/10* | (2006.01) |

(52) U.S. Cl.

CPC ..... *H04R 29/004* (2013.01); *H04R 1/1041* (2013.01); *H04R 3/007* (2013.01); *H04R 2201/107* (2013.01); *H04R 2420/09* (2013.01)

(58) Field of Classification Search

CPC ..... H04R 3/007; H04R 29/004; H04R 3/00; H04R 1/041; H04R 2420/09; H04R 2201/107

USPC ... 381/59, 111–115, 95, 56, 58, 77, 74, 384, 381/124; 73/645, 763, 584; 714/25; 455/67.11

See application file for complete search history.

(56) References Cited

U.S. PATENT DOCUMENTS

| | | | | |
|---|---|---|---|---|
| 4,575,587 | A * | 3/1986 | Stokes et al. | 379/27.01 |
| 4,752,959 | A * | 6/1988 | Matsumoto | 381/59 |
| 4,864,624 | A * | 9/1989 | Tichy | 381/55 |
| 4,887,298 | A * | 12/1989 | Haigler | 381/55 |
| 5,434,775 | A * | 7/1995 | Sims et al. | 705/7.12 |
| 5,464,461 | A * | 11/1995 | Whitson et al. | 55/480 |
| 5,528,695 | A * | 6/1996 | Klippel | 381/55 |
| 6,418,416 | B1 * | 7/2002 | Rosenberg et al. | 705/28 |
| 7,124,059 | B2 * | 10/2006 | Wetzer et al. | 702/184 |
| 7,602,923 | B2 * | 10/2009 | Lee et al. | 381/59 |
| 7,706,545 | B2 * | 4/2010 | Kost et al. | 381/55 |
| 7,742,606 | B2 * | 6/2010 | Kreifeldt et al. | 381/58 |

(Continued)

FOREIGN PATENT DOCUMENTS

| | | |
|---|---|---|
| JP | 2002159098 | 5/2002 |
| JP | 2003274490 | 9/2003 |
| JP | 2009152949 | 7/2009 |

*Primary Examiner* — Vivian Chin
*Assistant Examiner* — Con P Tran
(74) *Attorney, Agent, or Firm* — Fish & Richardson P.C.

(57) ABSTRACT

Embodiments of the invention include methods, apparatus, and systems for detecting a predicted future or current failure of a microphone of a headset. The failure may have been caused by organic matter buildup creating a signal path or short circuit across the microphone's circuitry. The headset is connected to a mobile device having a network interface that is used to send a notification message to a remote supply management system server. A failure detection circuit detects the failure based on a decrease in a microphone bias signal or increase in headset temperature over time. In some cases, the failure is based on an increase in a microphone bias signal over time. Upon detection of the failure, it signals that a failure notification be transmitted to the remote supply management system. The notification may then cause a new headset to be sent to the owner of the mobile device. Other embodiments are also described and claimed.

19 Claims, 8 Drawing Sheets

(56) References Cited

U.S. PATENT DOCUMENTS

| | | | | |
|---|---|---|---|---|
| 8,081,025 | B1 * | 12/2011 | Li | 327/540 |
| 2002/0071568 | A1 * | 6/2002 | Shuttleworth | 381/58 |
| 2002/0091594 | A1 * | 7/2002 | Rosenberg et al. | 705/28 |
| 2004/0158507 | A1 * | 8/2004 | Meek et al. | 705/28 |
| 2004/0184627 | A1 * | 9/2004 | Kost et al. | 381/120 |
| 2005/0185797 | A1 * | 8/2005 | Klein et al. | 381/59 |
| 2005/0239397 | A1 * | 10/2005 | Kreifeldt et al. | 455/3.01 |
| 2006/0147061 | A1 * | 7/2006 | Niwa et al. | 381/113 |
| 2006/0147062 | A1 * | 7/2006 | Niwa et al. | 381/113 |
| 2007/0121972 | A1 * | 5/2007 | Suzuki et al. | 381/174 |
| 2007/0222496 | A1 * | 9/2007 | Roesch et al. | 327/516 |
| 2008/0075306 | A1 * | 3/2008 | Poulsen et al. | 381/111 |
| 2008/0144845 | A1 * | 6/2008 | Martin et al. | 381/58 |
| 2009/0109582 | A1 * | 4/2009 | Jack et al. | 361/56 |
| 2009/0268899 | A1 * | 10/2009 | Tokuda et al. | 379/420.02 |
| 2009/0296952 | A1 * | 12/2009 | Pantfoerder et al. | 381/74 |
| 2011/0123041 | A1 * | 5/2011 | Turnbull et al. | 381/86 |
| 2011/0124381 | A1 * | 5/2011 | Wurtz | 455/570 |
| 2012/0014531 | A1 * | 1/2012 | Yamkovoy | 381/71.1 |
| 2012/0051554 | A1 * | 3/2012 | Modi et al. | 381/74 |

* cited by examiner

MICROPHONE HEADSET FAILURE DETECTING AND REPORTING

FIELD

Embodiments of the invention relate to detecting a current or a predicted future failure of microphone circuitry of a headset attached to a mobile device, transmitting a failure notification from the mobile device to a remote supply management system.

BACKGROUND

Mobile devices, such as laptop computers, tablet computers, MP3 players, and mobile phones (e.g., cell phones) are becoming increasingly common. Some of these mobile devices have grown more complex over time, incorporating many features, including, for example, MP3 player capabilities, web browsing capabilities, capabilities of personal digital assistants (PDAs) and the like. Mobile devices include charging and/or control jacks into which a charge cable, a power cable, and/or an interface cable to another device (e.g., a desktop computer or home entertainment system), may be plugged so as to charge the battery of the "host device" or transfer data between the host device and the external device. These devices may also include device (e.g., audio) jacks into which a headset or headphones may be plugged. In some cases, the headsets include, in addition to earphones for listening to output of the host device, a microphone to provide input to the host device over a microphone signal line. The later is biased with a DC voltage provided by the host device to operate the microphone.

SUMMARY

Embodiments of the invention include methods, apparatus, and systems for detecting a malfunction (also referred to as a "failure") of a microphone circuit of a headset attached to a mobile device, based on a measured microphone bias signal or a measured microphone bias line temperature of the headset. After the failure is detected, a failure notification may be sent from the mobile device to a remote supply management system. The failure notification may be transmitted to the remote supply management system, using a network interface. This may alert a distributor or manufacturer of the mobile device or headset to send a replacement headset to the user.

A failure detection unit or circuit may be located in the headset and/or in the mobile device housing. It may detect the failure based on a decrease of a microphone bias signal, or increase of a bias line temperature over time. Upon detection of the failure, it may transmit a signal identifying the failure to a controller of the mobile device. The failure may be a predicted future failure, or it may be current failure of a microphone circuit of the headset; the failure may be caused by organic matter buildup creating a signal path or short circuit across the microphone circuitry, where one should not exist.

As the matter first builds up, a parasitic high resistance may be detected. This detection may indicate a predicted future failure of the microphone or headset. As the matter continues to build up, a lower resistance or even a "short circuit" may be detected. This detection may indicate a current failure of the microphone or headset.

In some cases, the failure may be detected based on an increase of a microphone bias signal over time. These cases may be caused by organic matter buildup (e.g., causing corrosion), or mechanical separation, destroying a signal path or creating an open circuit in the microphone circuitry, where a signal path should exist. In these cases, as the matter (or corrosion) first builds up, or separation first begins, a low resistance may be detected, such as by detecting an additional resistance on an existing signal line. This detection may indicate a predicted future failure of the microphone or headset. As the matter (or corrosion) continues to build up, or separation continues, a higher resistance or even an "open circuit" may be detected on the signal line. This detection may indicate a current failure of the microphone or headset.

The mobile device may establish a network interface data connection to a remote supply management system server, to enable a failure notification be sent from the mobile device to a remote supply management system. After receiving the signal indicating the failure, mobile device may then transmit a failure notification to the remote supply management system. Thus, the supply management system can send the mobile device owner a new headset and/or a notification of the failure. Other embodiments are also described and claimed.

BRIEF DESCRIPTION OF THE DRAWINGS

The present embodiments are illustrated by way of example and not limitation in the figures of the accompanying drawings in which like references indicate similar elements.

DETAILED DESCRIPTION

Figure 1:
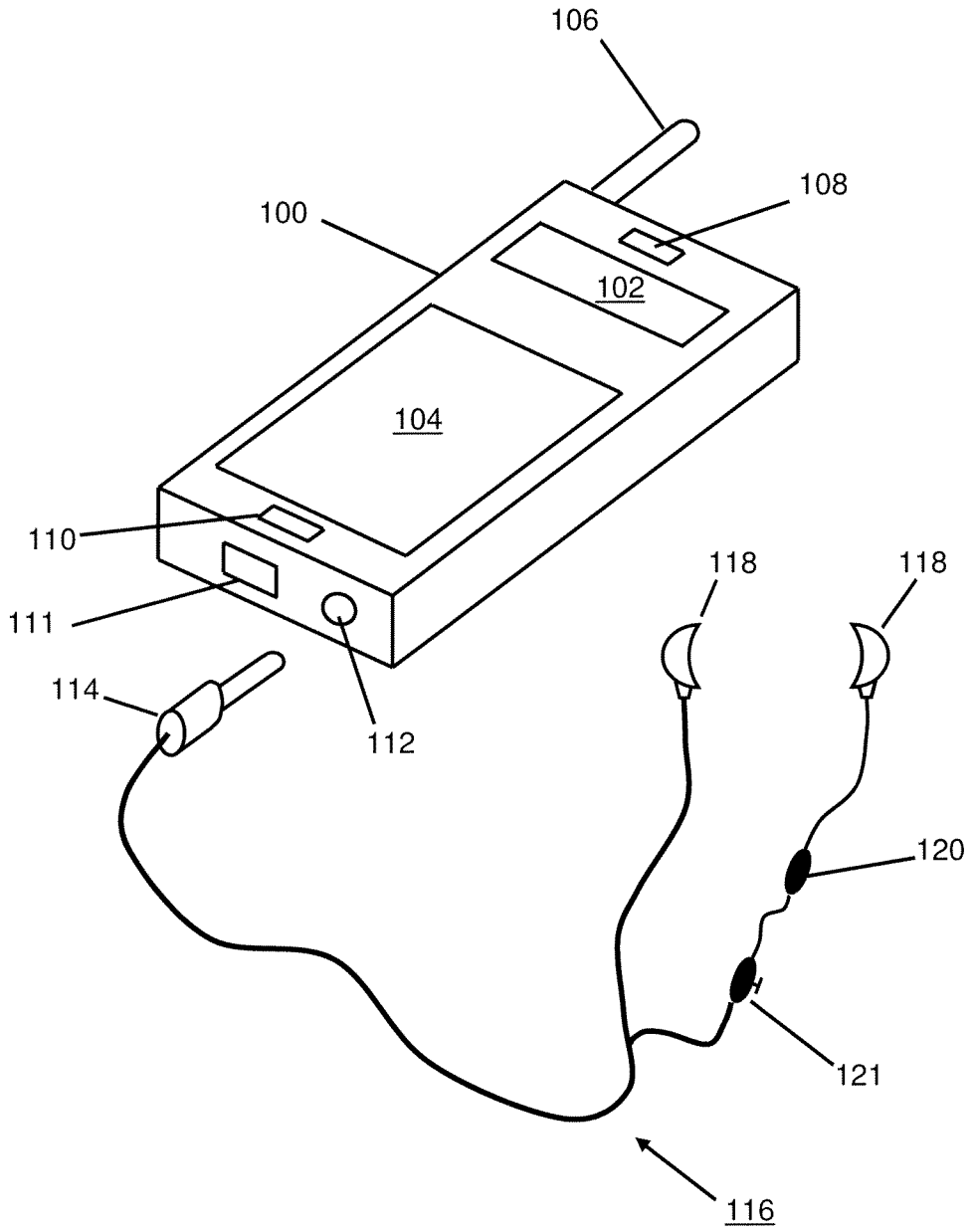
FIG. 1 shows an example of a mobile device, and a headset having a microphone.

Various embodiments and aspects of the inventions will be described with reference to details discussed below, and the accompanying drawings will illustrate the various embodiments. The following description and drawings are illustrative of embodiments of the invention and are not to be construed as limiting the invention. Numerous specific details are described to provide a thorough understanding of various embodiments of the invention. However, in certain instances, well-known or conventional details are not described in order to provide a concise discussion of embodiments of the inventions.

To provide a proper and efficient operation of mobile device headsets, microphone headset failure detecting and reporting mechanisms or circuitry are provided for determining whether a predicted future failure or a current failure of a microphone of a headset has occurred. Such a failure may be caused by organic matter buildup creating a signal path or short circuit across the microphone's circuitry, causing the microphone to malfunction. For example, as a headset is used over time, organic matter (e.g., dendrite, skin, hair, oil, sweat, and the like) may build up within the headset, such as matter that drops off of or is shed by a user of the device. As this matter builds up, it may eventually create a signal path where one should not exist, in circuitry of the headset. This may then cause a problem for the microphone functionality in the headset (e.g., circuitry in the headset to fail or become unusable for converting verbal input by the user into electronic audio signals). The headset may be connected to a mobile device. The mobile device may use a network interface (e.g., wireless, wired, computer network, email, text message, and the like) that can transmit a message (e.g., to send a failure notification) message to a remote supply management system, such as a computer server. The headset or the mobile device has a failure detection unit or circuit to detect the failure based on a decrease of a microphone bias signal or increase bias line (or headset) temperature over time; and upon detection of the failure, transmits a signal to a controller of the mobile device. The mobile device may then transmit a failure notification to the remote supply management system, such as to report the predicted future or current failure detected of the audio microphone headset. For instance, the mobile device may transmit the notification at the next opportunity, when entering a WiFi hotspot (using wireless technology), or when being docked via a USB cable with a networked desktop computer. The notification may cause the server to send the mobile device owner a new headset.

In some cases, the failure may be caused by organic matter buildup (e.g., causing corrosion of a signal line, wire or trace), or mechanical separation, destroying a signal path or creating an open circuit in the microphone circuitry, causing the microphone to malfunction. The failure detection unit detects the failure based on a increase of a microphone bias signal or decrease bias line (or headset) temperature over time; and upon detection of the failure, transmits the signal to a controller of the mobile device.

FIG. 1 illustrates mobile device 100 which includes charging and/or control jack 111, and headset 116 having microphone 120, in accordance with some embodiments of the invention. Device 100 can have display 102, user input interface 104, and external antenna 106. Display 102 can provide graphical information to a user. User input interface 104 can permit a user to input information into device 100. For example, user input interface 104 can include one or more buttons, touchpads, touchscreens, scrollwheels, clickwheels, sliders, other appropriate input mechanism, or combinations thereof. In some embodiments of the invention, display 102 and user input interface 104 can be combined, e.g., in a touchscreen or touchsensitive display. In some embodiments, a combined display and user input interface may occupy at least 60 percent or at least 65 percent of one side or surface of device 100. Mobile device 100 includes charge and/or control jack 111 into which a charge cable, a power cable, and/or interface cable to another device (e.g., a desktop computer or home entertainment system) may be plugged.

Device 100 also can be equipped with built-in speaker 108, built-in microphone 110, and headset jack 112. Jack 112 may be a device jack that can interface to a headset having an audio microphone and microphone circuit; audio equipment and players; and video equipment and players. Herein, the tennis "headset" and "headphone" may be used interchangeably, such as to describe an audio microphone headset having a microphone circuit.

Microphone button or switch 121 of headset 116 can be used to control the output of microphone 120 received at jack 112 and/or to control the behavior of device 100, such as by causing the device to change between two behaviors or actions. For example, actuating the switch sends a signal that instructs the host device to disconnect or hang up an ongoing phone call. Button 121 is optional and excluded in some of embodiments of device 100. Built-in speaker 108 can output audible sound to a user, while built-in microphone 110 can accept audible sound from the user. Headset jack 112 can accept plug 114 from headset 116. When headset plug 114 is properly inserted into headset jack 112, device 100 can be configured to output audible sound from earphones 118 rather than speaker 108; and to accept audible sound from headset microphone 120 rather than microphone 110. Thus, for some embodiments, device 100 may be described as a host device, such as a host to headset 116.

In some embodiments, device 100 may represent any one or more of the various electronic devices having jack 112, as described herein. Similarly, headset 116 may represent one or more accessory components having plug 114 connected to one end of a cable, such as also described further below. For instance, mobile device 100 may be a portable device, MP3 player (such as the iPod, by Apple, Inc. of Cupertino, Calif.), mobile phone (e.g., cell phones, such as the iPhone, by Apple, Inc.), and the like. For example, FIG. 1 shows device 100 as a mobile phone. In some cases, device 100 may be a laptop computer, tablet computer, personal digital assistant, and the like. Here, mobile device may not have certain features of FIG. 1, such as built-in speaker 108, built-in microphone 110, and/or external antenna 106. According to embodiments, either or both device 100 and headset 116 could include a microphone circuit failure detection circuit (such as circuit 129A and/or 129B); and mobile device 100 could include a network interface 117 as described further below (e.g., see FIGS. 3-7).

Figure 2:
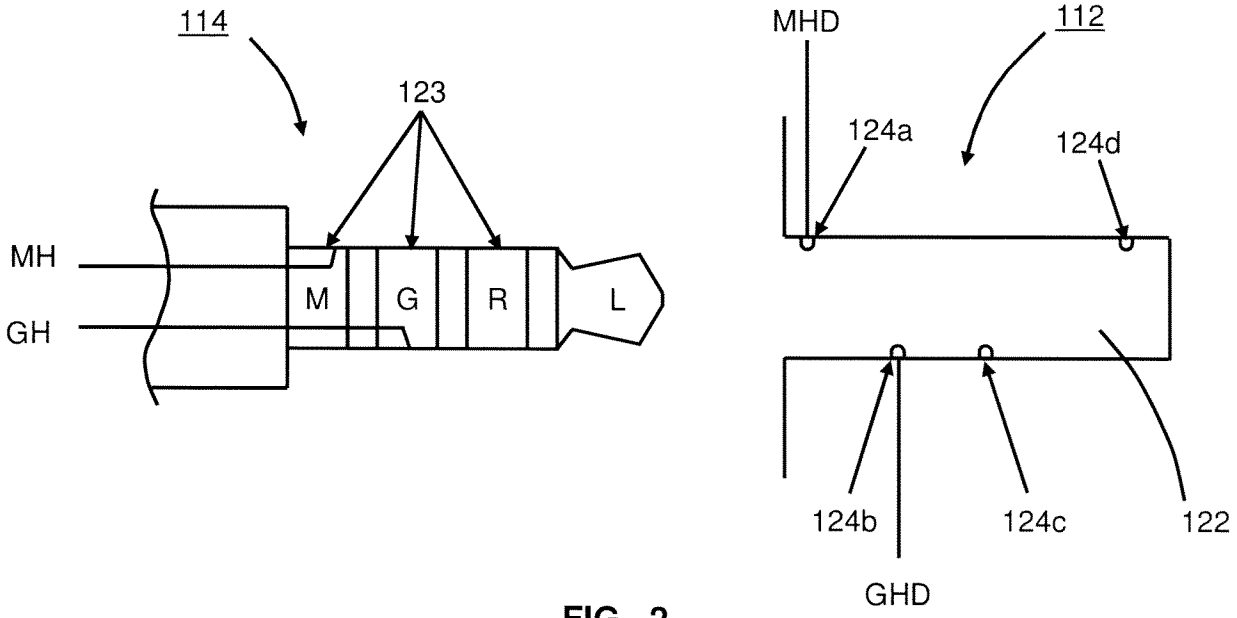
FIG. 2 shows an example of a headset jack and headset plug having a microphone bias line.

FIG. 2 illustrates headset jack 112 and headset plug 114 in greater detail in accordance with some embodiments of the invention. Headset jack 112 can have receptacle 122, within which is disposed one or more electrically conductive contacts 124*a*-124*d*. Headset plug 114 can have complementary electrically conductive contacts: microphone signal contact "M"; ground signal contact "G"; right earphone signal contact "R"; and left earphone signal contact "L". Each contact 124*a*-124*d* can be electrically isolated from adjacent contacts. Likewise, each contact M, G, R, and L also can be electrically isolated from adjacent contacts, such as by insulator rings 123 spaced along the length of plug 122.

FIG. 2 shows jack 112 having microphone bias line MHD of the device electrically and thermally coupled (e.g., directly attached) to contact 124*a*. Similarly, jack 112 has ground signal line GHD of the device electrically (e.g., directly attached) to contact 124*b*. Next, plug 114 has microphone bias line MH of the headset electrically and thermally coupled (e.g., directly attached) to contact M; and ground signal line GH of the headset electrically (e.g., directly attached) to contact G. When the plug 114 inserted into receptacle 122 of jack 112, contacts 124*a* and M may make contact to form "node" N1, and contacts 124*b* and G may make contact to form node N2 as described below for FIG. 3.

Figure 3:
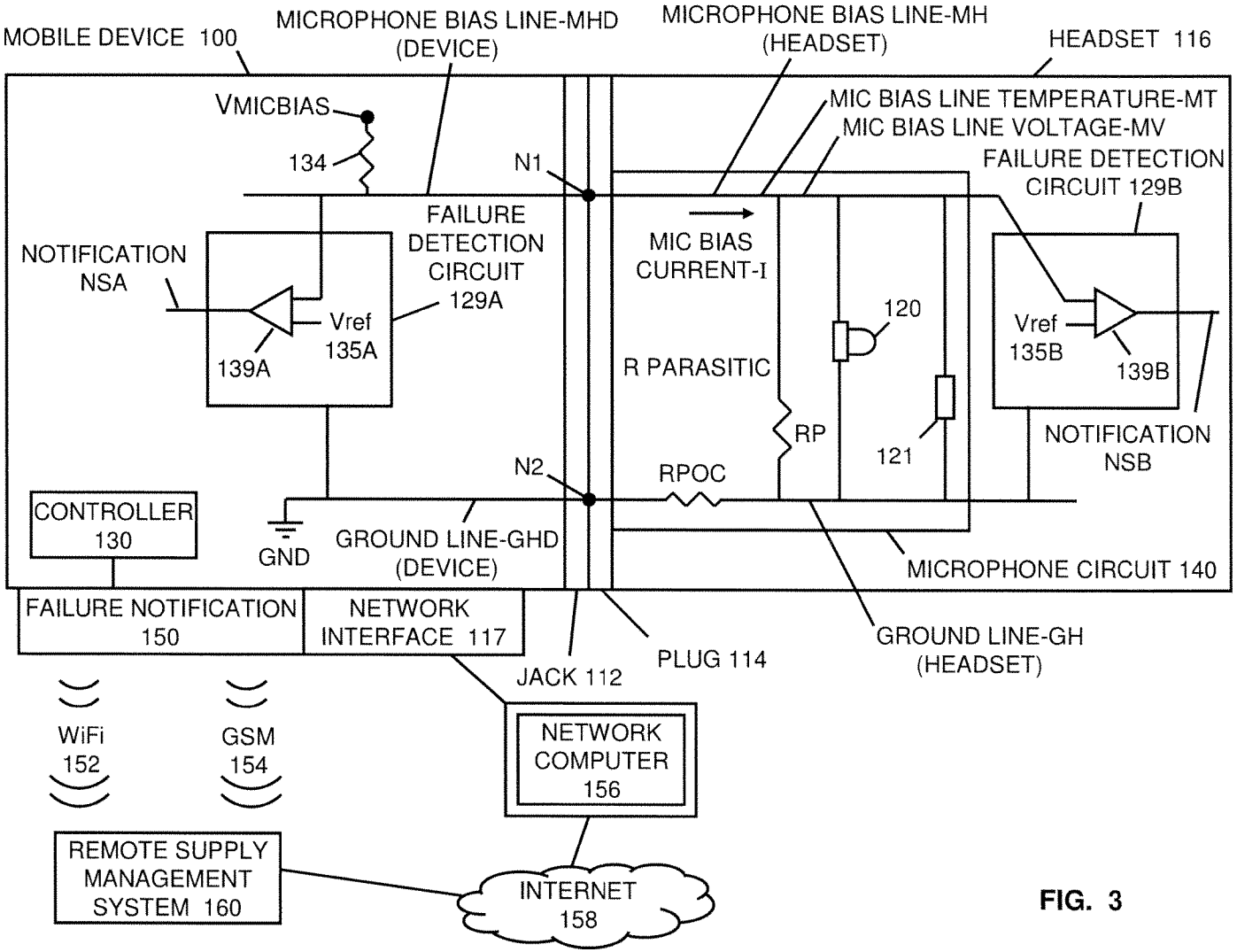
FIG. 3 is a combined circuit schematic and block diagram of a headset having a microphone circuit, a mobile device having a network interface to send a failure notification to a remote supply management system, and a microphone circuit failure detection circuit in the headset and/or in the mobile device.

FIG. 3 shows an example of an audio microphone headset failure detecting and reporting system and components in accordance with some embodiments of the invention. Note that the FIG. 3 left to right orientation of device 100 and headset 116 are the reverse of that of FIGS. 1-2 and 4. FIG. 3 shows headset 116 having a microphone circuit 140; and mobile device 100 having network interface 117 to send failure notification 150 to remote supply management system 160. In some cases, interface 117 is used to send notification 150, by email or text message. A microphone circuit failure detection unit or circuit may exist as circuit 129A in the mobile device and/or as circuit 129B in the headset. For example, in some embodiments, device 100 includes circuit 129A, or headset 116 includes circuit 129B. In other embodiments, both device 100 and headset 116 include circuits 129A and 129B.

Device 100 includes Vmicbias providing a direct current (DC) voltage bias signal through resistor 134 onto the microphone bias line of the device MHD. Line MHD may be electrically connected to the microphone bias line of the headset MH through node N1. For example, node N1 may represent a 100 percent (or nearly) conductive electrical and thermal connection between contact 124*a* of jack 112 and contact M of plug 114 (e.g., by physical contact). Similarly, device 100 includes ground GND providing a ground signal on ground line of the device GHD. Line GHD is coupled to the ground line of the headset GH through node N2. Node N2 may represent contact 124*b* of jack 112 having a 100 percent (or nearly) conductive electrical (and optionally thermal) connection to contact G of plug 114 (e.g., by physical contact).

Headset 116 includes microphone 120, button 121, microphone bias line MH, ground signal line GH, and possibly parasitic resistance RP and/or RPOC. Resistances RP and RPOC will be discussed further below. Microphone 120 may be used to converting verbal input by the user into electronic audio signals. Microphone 120 may use a field effect transistor or amplification system to amplify a sensed signal in the audio range, such as from a human voice. Button 121 may be a switch electronically coupled across the input and output of microphone 120.

For instance, microphone bias line MH provides a bias voltage to one end of the microphone, button, and possibly parasitic resistance. The other end of the microphone, button and parasitic resistance are coupled to ground signal line GH. In other words, the signal on line MHD may send to line MH, microphone bias DC voltage MV to be applied to the microphone circuit 140, where circuit 140 is electrically between voltage MV and ground GND. Thus, FIG. 3 shows microphone bias line MH having microphone bias line voltage MV, microphone line (or headset) temperature MT (e.g., an operating temperature of the line or headset plug due to the operation of device 100 and attached headset 116), and microphone bias current I being supplied at the end of the microphone, button, and parasitic resistance that are opposite from ground signal line GH.

In embodiments having circuit 129A in device 100, circuit 129A includes an electrical connection between line MHD and comparator 139A, and an electrical connection between Vref 135A and comparator 139A. Thus, comparator 139A can compare the signal or voltage level of line MHD to that of Vref 135A. As will be shown in FIGS. 5A and 5C, depending on these signal levels, comparator 139A may produce or output notification NSA.

Figure 5A:
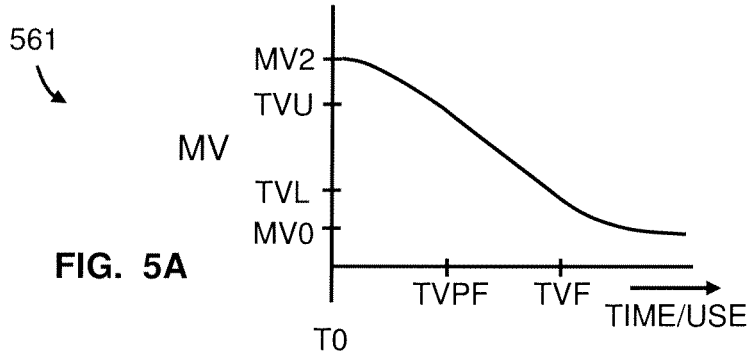
FIG. 5A shows an example microphone bias line voltage waveform, used for detecting a predicted future failure and a current failure of a microphone circuit of a headset.
Figure 5B:
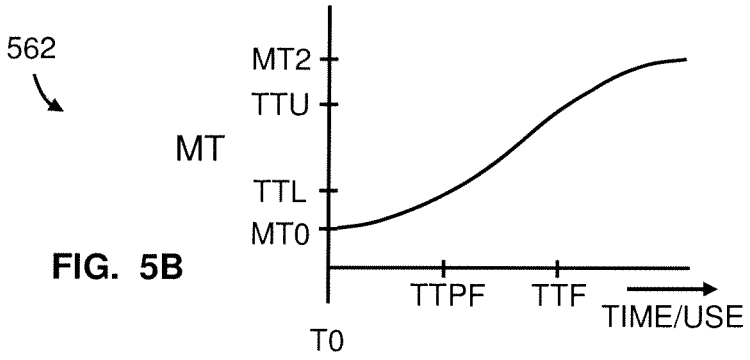
FIG. 5B shows an example microphone bias line temperature waveform, for detecting a predicted future failure and a current failure of a microphone circuit of a headset.
Figure 5C:
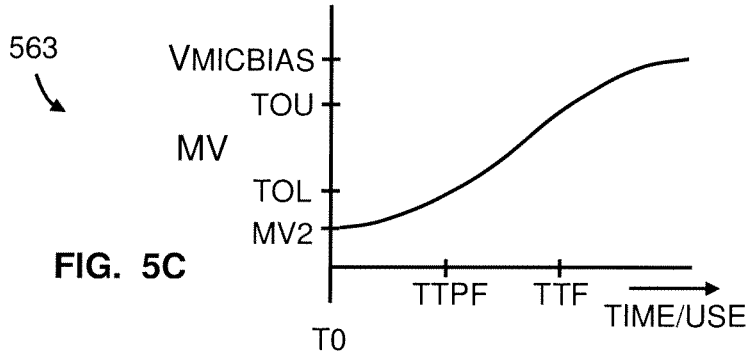
FIG. 5C shows another example microphone bias line voltage waveform, used for detecting a predicted future failure and a current failure of a microphone circuit of a headset.

In embodiments having circuit 129B and headset 116, circuit 129B includes an electrical connection between line MH and comparator 139B, and an electrical connection between Vref 135B and comparator 139B. Thus, comparator 139B can compare the signal or voltage level of line MH to that of Vref 135B. Also, as shown in FIGS. 5A and 5C, depending on these signal levels, comparator 139B may produce or output notification NSB.

Using circuits 129A and/or 129B, the headset and/or the mobile device can detect organic matter build up within the microphone or microphone circuit of the headset as the matter causes a signal path (e.g., parasitic resistance RP) where one should not exist. Such a path may be between traces of a printed circuit board or other circuitry of the microphone or microphone circuit. For instance, the path may form a parasitic resistance or impedance across the microphone signal path.

As the matter first builds up, a parasitic resistance may be detected (such as by detecting an increase or decrease in voltage MV) on the microphone bias line where an open circuit or no connection should exist. In some cases, an increase in operating temperature may be detected on the microphone bias line or plug. This detection may indicate a predicted future failure of the microphone or headset caused by the organic matter.

As the matter continues to build up, the parasitic resistance may lower to a lower resistance or relatively short circuit. This may also be detected to indicate a current failure of the microphone or headset caused by the organic matter. For instance, the lower parasitic resistance may cause the microphone to fail or become unusable for converting verbal input by the user into electronic audio signals. Thus, the headset is unusable for communicating by phone, or making audio recordings.

In some cases, circuits 129A and/or 129B can be used by the headset and/or the mobile device to detect corrosion (e.g., caused by organic matter buildup), or mechanical separation of a signal line, wire or trace within the microphone or microphone circuit of the headset destroying a signal path (e.g., creating parasitic resistance RPOC) where a path should exist. Such a path may be traces of a printed circuit board; signal wires or lines of the headset; electronic connections between circuitry and wires; or other circuitry of the microphone or microphone circuit. For instance, a parasitic resistance or impedance may form serially or in-line with the microphone, along the microphone signal path.

As the corrosion or mechanical separation begins, a parasitic resistance or increase in resistance may be detected on the microphone bias line where only a short circuit, a near zero resistance signal path, or only the microphone impedance should exist. This detection may indicate a predicted future failure of the microphone or headset caused by the organic matter, or mechanical separation.

As the corrosion (and/or organic matter buildup) or mechanical separation increases, the parasitic resistance may increase to a greater resistance or relatively open circuit. This may also be detected to indicate a current failure of the microphone or headset caused by the organic matter, or mechanical separation. For instance, the higher parasitic resistance may cause the microphone to fail or become unusable for converting verbal input by the user into electronic audio signals. Thus, the headset is unusable for communicating by phone, or making audio recordings. These concepts apply to a combination of corrosion and mechanical separation causing an aggregate parasitic resistance (e.g., such as represented by RPOC).

It is noted that voltage MV represents a DC bias voltage, although operation of microphone 120 may provide an audio signal modulated on or included within voltage MV. However, detect circuitry 129A and 129B (or other circuitry coupled to line MH and MDH) may include a filter (e.g., a low pass filter or a rectifier) so that the DC component of voltage MV may be measured, detected and compared, without being influenced by the audio signal. In addition, a filter or processor (e.g., controller 130) may be used by circuitry 129A and 129B to exclude changes in voltage MV caused by button 121, if present.

In some embodiments, circuit 129A receives or compares operating temperature MT to determine whether there is a predicted future failure or a current failure. In this case, the signal on line MHD may represent a signal or voltage converted (e.g., by a thermistor) from and representing the level of temperature MT on line MH, such as detected at node N1 by device 100. For example, circuitry or a converter existing in device 100 may convert the temperature detected at node N1 (e.g., at jack 112) to a voltage having a level representing that temperature. This way, circuit 129A may detect failures using temperature MT, similar to detecting failures using voltage MV as described above. A similar arrangement can be used to convert temperature MT to a voltage input to circuit 129B for comparison. For example, the temperature MT may be converted to a signal level or voltage by circuitry or a converter of headset 116, and sent on line MHD to circuit 129A.

Thus, comparator 139A or 139B can compare the voltage signal representing temperature MT of line MH to that of Vref 135A or 135B. As shown in FIG. 5B, depending on these signal levels, comparator 139A or 135B may produce or output notification NSA or NSB. Notification NSA or NSB may be a notification of a (e.g., may refer to a) predicted future failure of the microphone, microphone circuit and/or headset. Notifications NSA or NSB may also be a notification of a current failure of the microphone, microphone circuit and/or headset. In some cases, comparator 139A or 139B may output a different signal (e.g., not notification NSA or NSB) when neither a predicted future failure or current failure is indicated.

For embodiments that do not include circuit 129A but do include circuit 129B, notification NSB is sent to controller 130, such as through any one or more of the electrical connections between (e.g., contacts of) plug 114 and jack 112. For example, notification NSB may be sent as a signal on line MH to line MHD for receipt by controller 130. In some cases, headset 116 may have additional circuitry or a processor for sending notification NSB or another signal based on notification NSB to be received by controller 130.

Although circuits 129A and B are shown and described as example structures here, it can be appreciated that other circuitry designs can be used to perform the same function. It is also contemplated that the function of those circuits may be performed by hardware circuitry in combination with, programmable hardware logic, software and/or other control (e.g., controller 130).

Device 100 includes controller 130, such as a controller to receive notification signal NSA, and/or NSB. In response to or caused by receiving the notification signal, controller 130 may send a failure notification signal or message to or through network interface 117. For example, failure notification 150 may be sent or transmitted to remote supply management system 160. In some cases, notification 150 may be transmitted by various wireless (e.g., cell), wired, computer network, Internet, or other communication mediums. For example, notification 150 may be transmitted by interface 117 via or by WiFi 152 (e.g., wireless local area network), GSM 154 (e.g., Global System for Mobile Communications, such as a cell connection), network computer 156, a computer peripheral bus connection (e.g., USB) and/or Internet 158 to system 160. Charging and/or control jack 111 may be an instance of network interface 117.

Notification 150 may identify a predicted future or a current failure of the microphone circuit and/or headset. The notification may identify a failure level or scale of the failure, such as further described below for FIGS. 5A-5C. Notification 150 may identify a user or owner (e.g., a registered owner) of device 100 by name, residence address, email address or otherwise, such as based on data maintained in device 100, system 160, or otherwise. Also, notification 150 may identify the "failed" headset by part number, serial number or other sufficient identification information for a functional replacement to be identified.

Notification 150 may alert a distributor or manufacturer of the mobile device or headset to send a replacement headset to the user. For example, notification 150 may cause remote supply management system 160 (e.g., a computer or computer server) to send a message to an owner or user of the mobile device that describes the failure (e.g., predicted future or current failure, and/or a level of failure such as further described below for FIGS. 5A-5C). This may allow the user to decide when and how to obtain a replacement headset, such as by ordering a new headset once the owner has budgeted sufficient funds to pay for it.

In some cases, notification 150 may request, instruct or cause the remote supply management system (e.g., a computer server) to cause another headset to be sent (e.g., mailed) to an owner or user of the mobile device. The replacement may be a new or refurbished headset. The replacement may be covered under a warrantee, may be free or may have to be paid for by the owner. The remote supply management system may be (or may instruct another system or location that is) a distributor, distribution center, or other entity that sends the replacement.

Figure 4A:
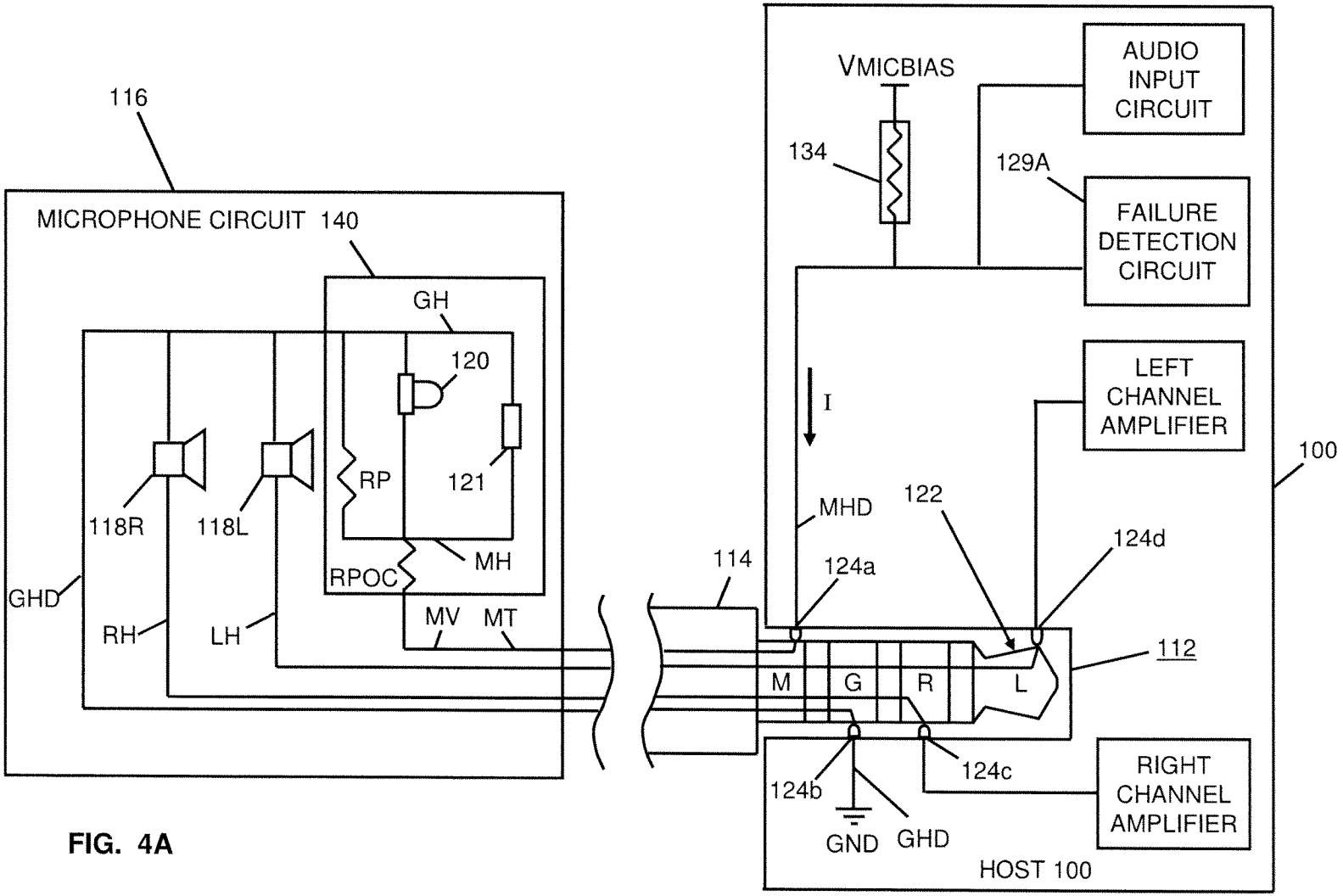
FIG. 4A show an example of a microphone circuit failure detection circuit in the mobile device.
Figure 4B:
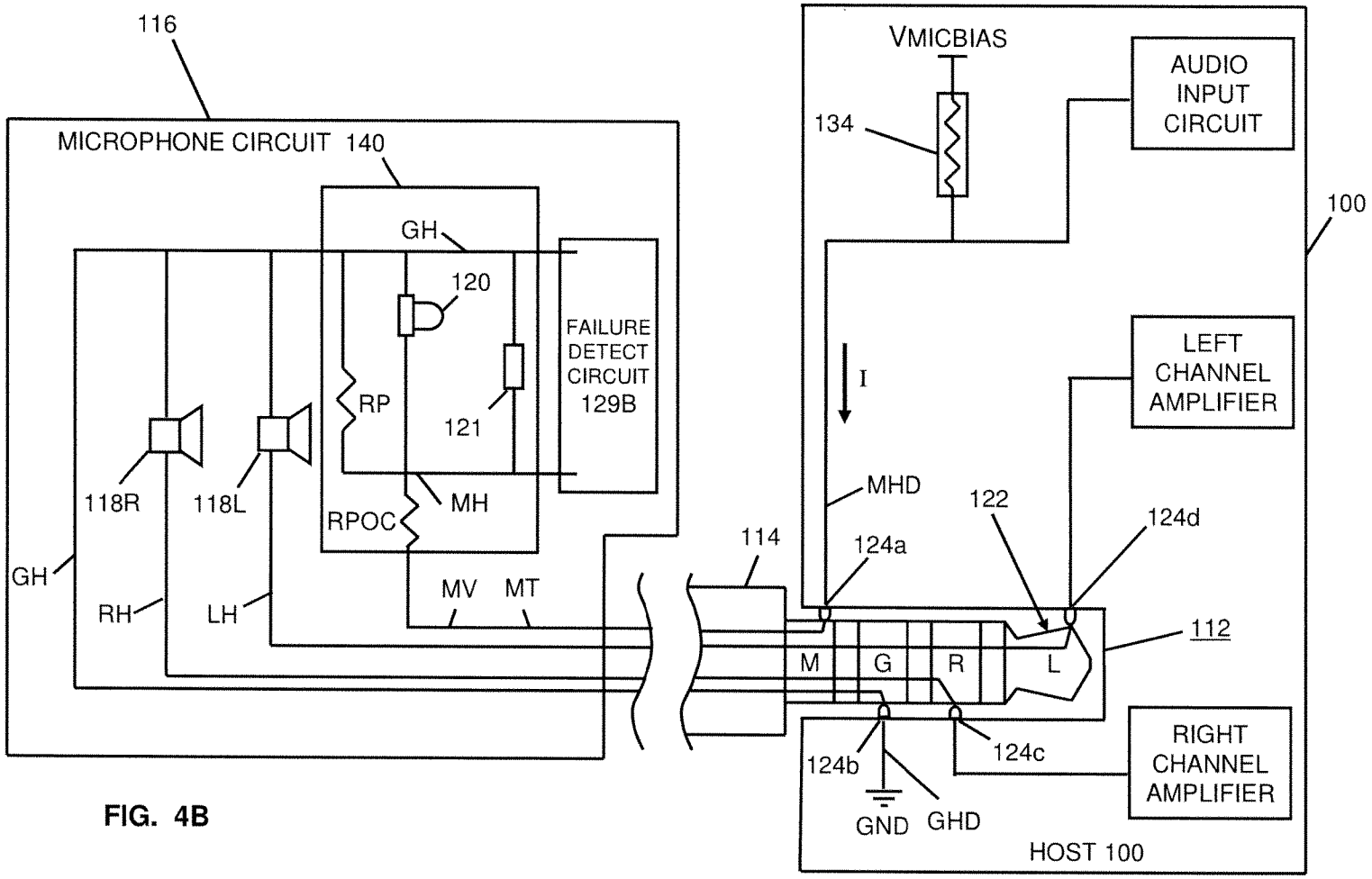
FIG. 4B show an example of a microphone circuit failure detection circuit in the headset.

FIGS. 4A-4B show examples of a headset jack, a headset plug, and electronic schematics of some embodiments of circuitry of headset 116 and mobile device 100. FIGS. 4A-4B show plug 114 inserted into receptacle 122 of jack 112, such that contacts 124*a*-124*d* of host 100 make electrical contact with (e.g., touch) contacts M, G, R, and L of headset 116, respectively. Contacts 124*a* and M can transmit (e.g., pass) signals (e.g., voltage MV and temperature MT) between circuit 140 of headset 116 and device 100. Similarly, contacts 124*b* and G transmit a ground signal; and contacts 124*c*-*d* and R-L can transmit audio signals between device 100 and earphones 118 of headset 116. When the plug is inserted, contacts 124*a* and M form Node 1, and contacts 124*b* and G form Node 2, such as described above for FIGS. 2-3.

FIGS. 4A-4B also show contacts 124*c* and 124*d* electrically connected to right channel amplifier and left channel amplifier of host 100, respectively. These amplifiers may transmit or provide the audio signals to speakers 118R and 118L of headset 114, respectively. FIGS. 4A-4B also show contact 124*a* electrically connected to bias voltage Vmicbias through resistor 134 of host 100. Each contact 124*a-d*, M, G, R and L also can be assigned to serve other roles, such as for various types of headsets.

FIGS. 4A-4B show microphone circuit 140 including microphone 120, button 121 (optional, and excluded in some embodiments), and resistance RP electronically coupled in parallel between line GND and line MH. Note that the up/down orientation of line GND and line MH of FIGS. 4A-4B are opposite of that shown in FIG. 3. In some case, circuit 140 includes all electronic circuitry, connectors, electronic connections, signal wires and lines between (e.g., disposed and/or forming electronic connections between) microphone contact M and ground contact G of the plug. Thus, parasitic resistance RP and/or RPOC could exist in the headset, anywhere between contact M and G of the plug. For instance, resistance RP may exist between or across signal wires (or lines) GH and MH, between the microphone and contacts M and G of the plug. Similarly, resistance RPOC may exist on or along either wire GH or MH, such as between the microphone and contacts M and G of the plug.

FIG. 4A shows an example of a microphone circuit failure detection circuit 129A in the mobile device 100. Contact 124*a* and line MHD are electrically connected to audio input circuit and to detection circuit 129A. Although not shown in FIG. 4A, audio input circuit may detect or measure voltage MV, such as based on a voltage drop across resistor 134, for converting verbal input by the user into electronic audio signals. Detection circuit 129A may detect or measure voltage MV and/or temperature MT, such as described in FIGS. 3 and 5.

FIG. 4B show an example of a microphone circuit failure detection circuit 129B in the headset 116. Contact M and line MH are electrically connected to microphone circuit 140 and to detection circuit 129B. Detection circuit 129B may detect or measure voltage MV and/or temperature MT, such as described in FIGS. 3 and 5, and/or using other circuitry known to perform those functions.

FIG. 5A shows an example microphone bias line voltage signal output waveform, used for detecting a predicted future failure and a current failure of a microphone circuit of a headset. FIG. 5A shows an example of waveform 561 of microphone bias line voltage MV with respect to time and/or use of headset 116. For example, at time T0, such as when the headset is new, voltage MV may be at level MV2. Level MV2 may be a voltage equal to Vmicbias×(value of resistance of microphone 120/(value of resistance of microphone 120+value of resistor 134)).

As the headset (and microphone) are used over time and organic matter begins to create a signal path in the microphone circuit where one should not exist, voltage MV decreases due to current flowing through parasitic resistance created by the matter. For example, the organic matter buildup may create parasitic resistance RP between line MH and line GH, where one should not exist. For example, the organic matter may include dendrite, skin, hair, oil, sweat, and the like that have dropped off of or been shed by the user (and possibly caught by the headset cord and dropped onto the microphone circuit through the microphone opening, switch opening or other opening to an interior of the headset). The organic matter may also include dirt, dust, and the like that accumulates with, on, or due to the organic matter buildup.

For instance enough matter (e.g., length and thickness) may build up on circuitry, traces, and/or a printed circuit board of the microphone circuitry to conduct electricity. Thus, resistance RP may form across microphone 120, button 121 if present, and/or other circuitry or traces of microphone circuit 140. Specifically, the path may form a parasitic resistance or impedance across the microphone signal path. As the matter first builds up, a parasitic resistance (as compared to the impedance of the microphone) may be detected where an open circuit or no connection should exist. For example, the microphone line bias voltage could be used to detect a future or current failure, caused by resistance RP, such as by detecting resistance RP from a decrease in voltage MV or increase in temperature MT. FIG. 5A shows that at time of predicted future failure TVPF, voltage MV crosses to less than upper threshold voltage TVU. By crossing below the upper threshold, voltage MV may cause comparator 139A or 139B to output a notification signal NSA or NSB to be received by controller 130, indicating a predicted future failure.

As organic matter continues to build up (e.g., increases in buildup), thicken and/or spread out, it may lower parasitic resistance RP. For instance, the parasitic resistance may lower to a lower resistance or relatively short circuit (as compared to resistance of the microphone) that may be detected where no connection should exist. Although this path may not be a direct short to ground, it is substantially lower in impedance than that of a headphone microphone. FIG. 5A shows that at time of current failure TVF voltage MV crosses to less than lower threshold voltage TVL. By crossing below the lower threshold, voltage MV may cause comparator 139A or 139B to output a notification signal NSA or NSB to be received by controller 130, indicating a current failure. Eventually, enough matter may build up to cause voltage MV to be reduced to MV0, approximately short circuiting across circuit 140.

FIG. 5B shows an example microphone bias line temperature waveform, for detecting a predicted future failure and a current failure of a microphone circuit of a headset. FIG. 5B shows an example of waveform 562 of microphone bias line temperature MT with respect to time and/or use of headset 116. Thus, similar to FIG. 5A, an increase in operating temperature may be detected on the microphone bias line. For example, at time T0, such as when the headset is new, temperature MT may be at level MT0. Level MT0 may be a temperature equal to the optimum or nominal design specification expected operating temperature of line MT during the operation of device 100 and attached headset 116.

As the organic matter begins to create a signal path in the microphone circuit, temperature MT increases due to current flowing through the parasitic resistance RP between line MH and line GH. FIG. 5B shows that at time of predicted future failure TTPF temperature MT crosses to greater than lower threshold temperature TTL. By crossing above the lower threshold, temperature MT may cause comparator 139A or 139B to output a notification signal NSA or NSB to be received by controller 130, indicating a predicted future failure.

As organic matter continues to build up and the parasitic resistance lowers to a lower resistance or relatively short circuit, temperature MT further increases due to increased current flowing through the lower parasitic resistance RP between line MH and line GH. FIG. 5B shows that at time of current failure TTF temperature MT crosses to greater than upper threshold temperature TTU. By crossing above the upper threshold, temperature MT may cause comparator 139A or 139B to output a notification signal NSA or NSB to be received by controller 130, indicating a current failure. Eventually, enough matter may build up to cause temperature MT to increase to MT2, approximately short circuiting across circuit 140.

In some embodiments, notification signal NSA or NSB can identify a level or scale of the predicted future failure or a current failure. For example, based on the waveforms of FIGS. 5A-5B, comparator 139A or 139B may indicate a more granular or detailed level or scale of predicted future failure or a current failure as compared to the upper and lower thresholds. This information may be communicated to controller 130, to system 160, and or to the owner or user of device 100. In this way, controller 130, system 160, and or the owner or user can determine whether a replacement headset should be sent immediately (e.g., current failure with voltage MV at MV0, or temperature MT at MT2), in the next days or weeks (e.g., predicted future failure with voltage MV just above TVL, or temperature MT just below TTU), or in the next months and beyond (e.g., predicted future failure with voltage MV just below TVU, or temperature MT just above TTL).

Concepts similar to those described above for FIGS. 5A and 5B apply to parasitic resistance RPOC as well, such as is shown in FIG. 5C. For example, detection circuitries 129A and 129Bs, comparators 139A and 139B, controller 130, failure notification 115, network interface 117, and remote supply management system 160 may also operate as noted above for resistance RP, but with respect to resistance RPOC. That is, they may detect a future or current failure; measure a voltage; establish a connection; transmit a failure notification; and/or replace a headset, based on detecting resistance RPOC. For example, the microphone line bias voltage could be used to detect a future or current failure, caused by resistance RPOC, such as by detecting resistance RPOC from an increase in voltage MV along the microphone line, or in series with circuit 140.

FIG. 5C shows an example of waveform 563 of microphone bias line voltage MV with respect to time and/or use of headset 116. For example, as the headset (and microphone) are used over time and organic matter buildup (e.g., causing corrosion of a signal line, wire or trace) or mechanical separation (or both), begins to destroy a signal path where one should exist by creating a parasitic resistance (represented here by RPOC). As a result, voltage MV increases due to less current flowing through the signal path due to the parasitic resistance increasing resistance of the path. For instance, resistance RPOC may be created along or on line MH or line GH (or both), where such resistance should not exist. In some cases, resistance RPOC may be measured or detected where almost no resistance should exist (e.g., where only a signal line should exist). In some cases, resistance RPOC may be detected where almost no resistance other than the impedance of microphone 120 should exist (e.g., where only a signal line and the microphone should exist).

The organic matter (e.g., as described herein) may be caught by the headset cord and dropped onto a joint or connection (e.g., physical and/or electrical) between line MH or GH (or both) and the plug, the microphone circuit board, the switch, the microphone, or any combination of the above. For instance, enough matter (e.g., length, width and thickness) may build up on circuitry, traces, lines, and/or a printed circuit board of the microphone circuitry to cause corrosion (e.g., corrosion and/or rust caused by or resulting from existence of the matter) that reduces conduction of electricity. This parasitic resistance RPOC may form along line MH line GH, microphone 120, button 121 if present, and/or other circuitry or traces of microphone circuit 140. Specifically, the corrosion may form a parasitic resistance or impedance along the microphone signal path. As the matter and/or corrosion first builds up, a parasitic resistance (e.g., as compared to the impedance of a signal line or the microphone) may be detected where only a signal line, or the resistance of the microphone should exist.

Also, mechanical separation (e.g., as described herein) may be created in a joint or connection between line MH or GH (or both) and the plug, the microphone circuit board, the switch, the microphone, or any combination of the above. For instance, enough mechanical separation (e.g., length and thickness of separation between one or more connections) may build up between circuitry, traces, lines and/or a printed circuit board of the microphone circuitry to reduce conduction of electricity. This parasitic resistance RPOC may form between line MH, line GB, microphone 120, button 121 if present, and/or other circuitry or traces of microphone circuit 140. Specifically, the mechanical separation may form a parasitic resistance or impedance along the microphone signal path. As the mechanical separation first separates (e.g., in length and thickness of one or more connections), a parasitic resistance (e.g., as compared to the impedance of a signal line or the microphone) may be detected where only a signal line, or the resistance of the microphone should exist. In some embodiments, resistance RPOC represents an aggregate of all resistance caused by organic matter, corrosion, and/or mechanical separation in the microphone signal path, where none should exist (e.g., with respect to the design specification). For example, the microphone line bias voltage could be used to detect a future failure, caused by resistance RP, such as by detecting resistance RP from a decrease in voltage MV or increase in temperature MT.

FIG. 5C shows that at time of predicted future failure TVPF voltage MV crosses to greater than lower threshold voltage TOL, due to parasitic resistance RPOC buildup. By crossing below the lower threshold, voltage MV may cause comparator 139A or 139B to output a notification signal NSA or NSB to be received by controller 130, indicating a predicted future failure.

As parasitic resistance RPOC increases, it may increase to a greater resistance or relatively open circuit that may be detected where only a short circuit, or the resistance of the microphone should exist. For instance, although resistance RPOC may not be an open circuit, it is substantially higher in impedance than that of a headphone microphone. FIG. 5C shows that at time of current failure TVF voltage MV crosses to greater than higher threshold voltage TOU. By crossing above the higher threshold, voltage MV may cause comparator 139A or 139B to output a notification signal NSA or NSB to be received by controller 130, indicating a current failure. Eventually, if resistance RPOC increases enough voltage MV may increase to Vmicbias (e.g., due to an approximately an open circuit along the microphone line, or in series with circuit 140).

In an example where the headset plug is properly inserted into the jack of the device, and a normal or nominal microphone bias line voltage MV is approximately 1.8 to 2.1 volts (here Vmicbias may be approximately 2.7 volts), the following may apply. Threshold TVU may be approximately 1.8 volts, or may be a minimum value at which the bias voltage is in a "normal" range as indicated by a design specification. Also, threshold TVL may be approximately 1.56 volts, or may be a minimum value at which the microphone circuit is able to provide functionality and/or acoustic quality as indicated by a design specification. In addition, threshold TOL may be approximately 2.65 volts or may be a voltage within approximately 50 millivolts below from Vmicbias.

Thus, in the context of an example where a normal DC signal for voltage MV is 1.8 to 2.1 volts, if the measured voltage MV is less than threshold TVL (such as 1.56 volts) the failure detection circuit may conclude that there is a short circuit across microphone circuit 140; while if the DC bias signal MV is above threshold TOL (approximately 2.65 volts) the failure detection circuit may conclude that there is an open circuit failure in the microphone line (e.g., in the headset, electrically somewhere between contacts M and G of plug 114). Of course detecting the short circuit situation presumes that the optional microphone button 121 is not pressed at the time of detection, and is not causing a short circuit in the microphone circuit, where one should exist and is desired when the button is pressed. For instance, detecting resistance RPOC may include monitoring or sampling voltage MV continuously over a period of time, or periodically at intervals greater than an expected button push action period. The results of monitoring or sampling voltage MV can be averaged. In some cases, they can be compared and results outside a variance (e.g., plus or minus 10 or 20 percent) can be discarded (such variances may represent a button push, and may possibly throw off the average).

Similar to the description for resistance RP, in some embodiments, notification signal NSA or NSB can identify a level or scale of the predicted future failure or a current failure.

Figure 6:
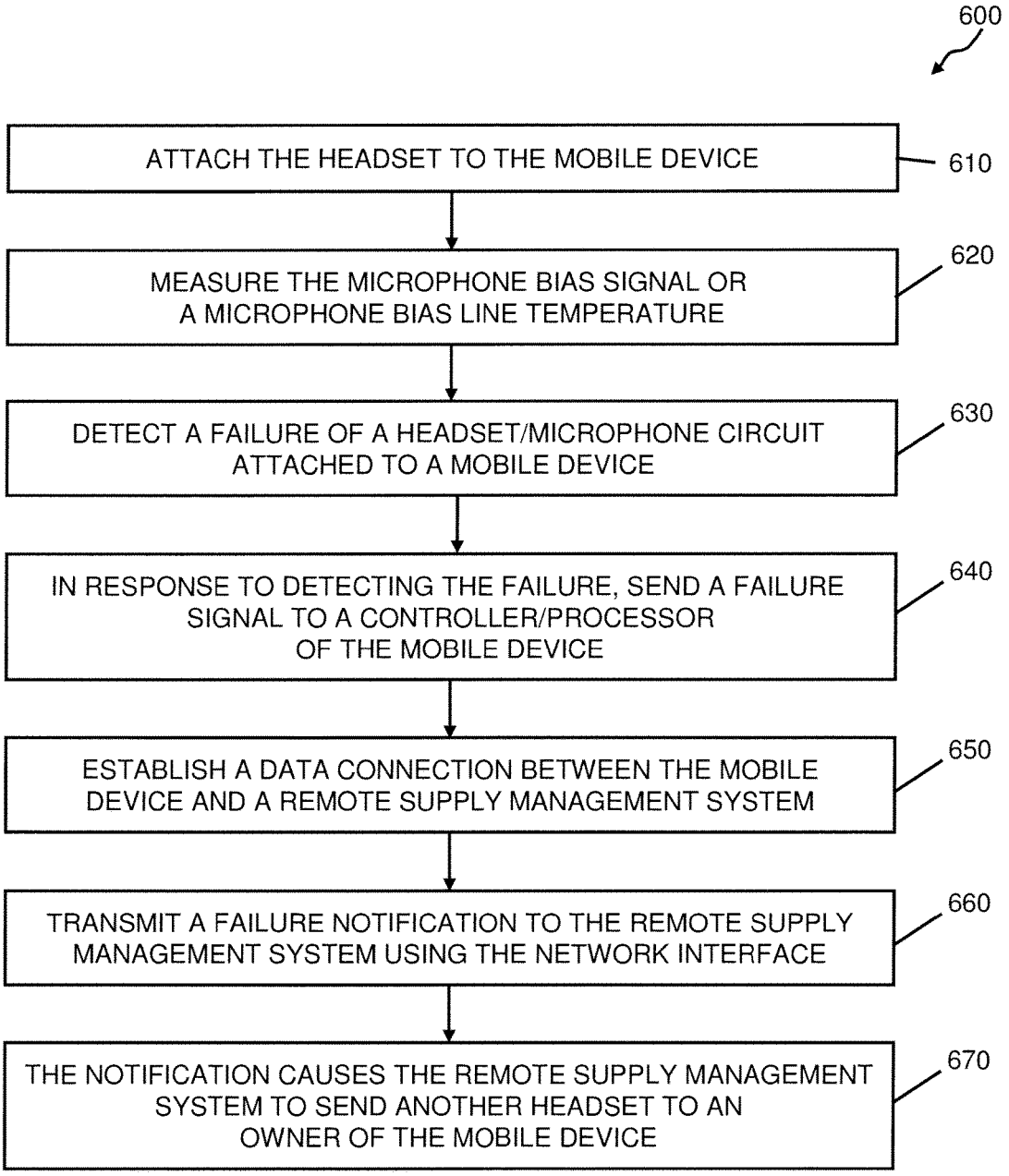
FIG. 6 shows an example process flow, for detecting a failure of a microphone circuit of a headset, establishing a data connection between the mobile device and a remote supply management system, and transmitting a failure notification to the remote supply management system.

FIG. 6 shows an example process flow, for detecting a failure of a microphone circuit of a headset, establishing a data connection between the mobile device and a remote supply management system, and transmitting a failure notification to the remote supply management system. FIG. 6 shows process 600 which may embody a process performed by embodiments described for FIGS. 1-5.

Process 600 starts with block 610 where the headset is attach to the mobile device. Block 610 may correspond to completely inserting plug 114 of headset 116 into receptacle 122 of jack 112 to at least form nodes N1 and N2. After block 610, device 100 may be connected to headset 116 having a microphone bias signal and a temperature on microphone bias line MH. Subsequently, device 100 may be used to communicate by phone with or make audio recordings of electronic audio signals received on line MHD from line MH that have been converted by microphone 120 of headset 116 from verbal input of the user.

At block 620 the microphone bias line signal or a microphone bias line temperature is measured. For instance block 620 may include circuit 129A and/or 129B measuring a signal level (e.g., voltage MV or current I, in some cases) and/or the microphone bias line temperature MT, of or on line MHD and/or MH as described above (e.g., see FIGS. 3-5).

At block 630 a failure of headset 116 (e.g., microphone 120 and/or microphone circuit 140) attached to device 100 is detected. The failure may be caused by organic matter causing a signal path (e.g., resistance RP) or short circuit across the microphone circuitry of the headset as described above (e.g., see FIGS. 3-5). In some cases, the failure may be caused by organic matter or mechanical separation causing a resistance (e.g., resistance RPOC) or open circuit along a signal path of the microphone circuitry of the headset as described above (e.g., see FIGS. 3-5). Block 630 may include a microphone circuit failure detection unit or circuit (e.g., of the mobile device and/or headset) detecting a predicted future failure and/or a current failure of a microphone circuit by comparing the detected microphone line bias signal and/or temperature to one or more thresholds, such as described for FIGS. 5A-5C above, and FIG. 7 below.

At block 640, in response to detecting the failure, a failure signal is sent or transmitted to controller or processor 130 of mobile device 100. Block 640 may include circuit 129A and/or 129B (e.g., comparator 139A and/or 135B) producing or transmitting output notification NSA and/or NSB to controller 130, such as described above for FIG. 3.

At block 650 a data connection between mobile device 100 and remote supply management system 160 is established. Block 160 may include establishing a network interface (e.g., wireless, wired, computer network, email, text message, and the like) to send data (e.g., messages and/or packets) using, various mediums, including those described above for FIG. 3. For instance, the mobile device may establish a network interface data connection to a remote supply management system server to enable a failure notification be sent from the mobile device to a remote supply management system.

At block 660, in response to or caused by receiving the notification signal, controller 130 may send failure notification signal or message 150 to system 160. For example, failure notification 150 may be sent or transmitted to remote supply management system 160 using one or more of the various systems described for block 650.

In some cases, although controller 130 has received notification NSA and/or NSB, the controller has to wait for the data connection to be established before sending notification 150. For instance, controller 130 may have to delay sending notification 150 until device 100 is interfaced with a computer (host) or has wireless phone capability (e.g., cell). This delay may be a few seconds, minutes, or days. In cases where device 100 is interfaces with a host computer application having network communication access (e.g., is an iPod or iPhone), it may have to wait until it is interfaced with the host computer application (e.g., iTunes from Apple Inc. of Cupertino, Calif.) to send notification 150 to remote supply system 160 (e.g., AppleCare from Apple Inc. of Cupertino, Calif.), such as via network computer 156 and/or internet 158 (e.g., see FIG. 3) (e.g., itunes sync. from Apple Inc. of Cupertino, Calif.). In cases where device 100 is an iPhone, it may have to wait until it has WiFi or GSM data capability to send notification 150, such as via WiFi 152 and/or GSM 154 (e.g., see FIG. 3).

At block 670 a replacement headset is sent to the owner. Block 670 may include notification 150 requesting the replacement, and having headset and/or owner data, such as described above for FIG. 3. Upon receiving notification 150, the remote supply management system may send the replacement headset or notify the owner of the failure, such as described above for FIGS. 3-5.

Certain embodiments may be described by only including blocks 630, 650 and 660. Some embodiments may be described by only blocks 630 and 660. Some embodiments only require block 630. Also, certain embodiments are described only by blocks 610, 620 and 630. Some embodiments only require blocks 610-640. Other embodiments require all of blocks 610-670.

Figure 7:
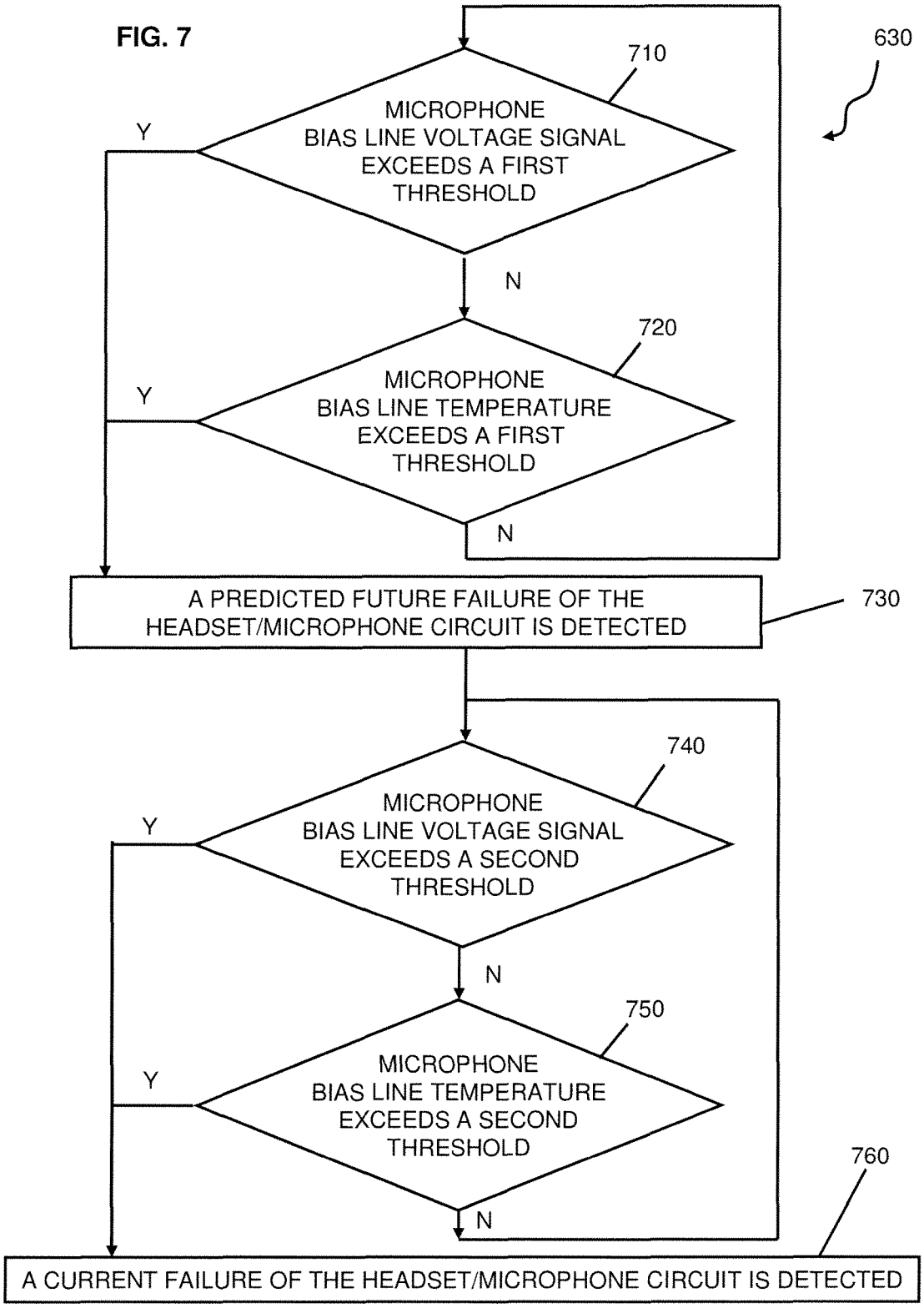
FIG. 7 shows an example process flow, for detecting a predicted future failure and a current failure of a microphone circuit of a headset based on a microphone bias line signal and/or temperature.

FIG. 7 shows an example process flow, for detecting a predicted future failure and/or a current failure of a microphone circuit of a headset. FIG. 7 may show block 630 which may embody a process performed by embodiments described for FIGS. 1-6. In some cases FIG. 7 may start after block 620 of FIG. 6. Some embodiments of FIG. 7 exclude blocks 720 and 750, such as where temperature MT is not being considered or detected. Some embodiments of FIG. 7 exclude blocks 710 and 740, such as where voltage MV is not being considered or detected. Thus, FIG. 7 may start with decision block 710, or with block 720 for embodiments that exclude block 710.

At block 710 it is determined whether a microphone bias line signal (e.g., voltage MV or current I) exceeds a first threshold. For instance, block 710 may include detecting that microphone bias line voltage signal MV is less than first voltage threshold (e.g., by being compared to TVU such as described for FIG. 5A). In some cases, block 710 may include detecting that microphone bias line voltage signal MV is greater than third voltage threshold (e.g., by being compared to TOL such as described for FIG. 5C). Some embodiments include detecting whether signal MV is less than TVU, or detecting whether signal MV is greater than TOL. Some embodiments include detecting both simultaneously. If the microphone bias line signal exceeds a first threshold, the process may continue block 730. If the microphone bias line signal does not exceed a first threshold, the process may continue block 720. Some embodiments exclude block 720, so that if the microphone bias line signal does not exceed a first threshold, the process returns to block 710.

At decision block 720 it is determined whether microphone bias line temperature MT exceeds a first threshold. For instance, block 720 may include detecting that signal MT is greater than a first temperature threshold (e.g., by being compared to TTL such as described for FIG. 5B). Block 710 may be performed at the same time (or over the same period) as block 720. If the microphone bias temperature is greater than a first threshold, the process may continue block 730. If the microphone bias line signal is not is greater than a first threshold, the process may continue block 710. Some embodiments exclude block 710, so that if the microphone bias temperature is not greater than a first threshold, the process returns to block 720.

At block 730 it is determined that a predicted future failure of the headset (e.g., microphone circuit) is detected. Block 730 may include descriptions of detecting a predicted future failure described above for FIGS. 3-6. After block 730 the process continues to block 740 (or block 750 for embodiments that exclude block 740).

At block 740 it is determined whether a microphone bias line signal (e.g., voltage MV or current I) exceeds a second threshold. For instance, block 740 may include detecting that microphone bias line voltage signal MV is less than second voltage threshold (e.g., by being compared to TVL such as described for FIG. 5A). In some cases, block 740 may include detecting that microphone bias line voltage signal MV is greater than forth voltage threshold (e.g., by being compared to TOU such as described for FIG. 5C). Some embodiments include detecting whether signal MV is less than TVL, or detecting whether signal MV is greater than TOU. Some embodiments include detecting both simultaneously. If the microphone bias line signal exceeds a second threshold, the process may continue block 760. If the microphone bias line signal does not exceed a second threshold, the process may continue block 750. Some embodiments exclude block 750, so that if the microphone bias line signal does not exceed a second threshold, the process returns to block 740.

At decision block 750 it is determined whether microphone bias line temperature MT exceeds a second threshold. For instance, block 750 may include detecting that signal MT is greater than a second temperature threshold (e.g., by being compared to TTU such as described for FIG. 5B). Block 740 may be performed at the same time (or over the same period) as block 750. If the microphone bias temperature is greater than a second threshold, the process may continue block 760. If the microphone bias line signal is not is greater than a second threshold, the process may continue block 740. Some embodiments exclude block 740, so that if the microphone bias temperature is not greater than a second threshold, the process returns to block 750.

At block 760 it is determined that a current failure of the headset (e.g., microphone circuit) is detected. Block 760 may include descriptions of detecting a predicted future failure described above for FIGS. 3-6. After block 760 the process may continue to block 640 (or another block) of FIG. 6.

Some embodiments of FIG. 7 exclude blocks 710-730; or exclude blocs 740-760. In some cases, only blocks (710 or 720) and 730 exist. In other cases, only blocks (740 or 750) and 760 exist.

In some embodiments, in place of sending a failure signal at block 640, other actions or behaviors may be taken by controller 130, such as increasing the gain of the microphone (e.g., when a predicted future failure is detected). In some embodiments, some or all of the blocks 620-660 and FIG. 7 are caused by circuit 129A or B; or control unit 130. In addition, some or all of those blocks may describe controlling behavior of device 100.

It is also considered that the concepts above may be applied to other peripherals, cables, and components that interface with device 100. For instance, the concepts above can be applied to any component that plugs into jack 112 or into charging and/or control jack 111. Failure detect circuits similar to circuit 129A and/or 129B may exist within device 100 and/or the component to detect voltage, current and/or temperature of a DC power line or bias line of the component, similar to the descriptions above. For example, a failure detection circuit could exist in device 100 and/or a cord attached to jack 111 to detect a failure of the cord or a component attached to jack 111. Similar to the description above for the microphone circuit failure detection circuit, the failure detection circuit(s) attached to jack 111 could detect a voltage or temperature to determine whether the cord had a predicted future or current failure. Specifically, the detection descriptions above can be applied to any DC voltage power line (e.g., bias power line) of the cord attached to jack 111. In some embodiments, a failure detect circuit can detect a predicted future failure and/or a current failure of a charge cable, a power cable, and/or interface cable to another device (e.g., a desktop computer or home entertainment system) plugged into jack 111. A failure notification for that component can then be sent to system 160, such as described above.

In some cases, device 100 may have multiple failure detect circuits coupled to jack 112 and/or jack 111 to detect failures of different or multiple components. Device 100 may also use controller 130 to change or adjust the level of Vref 135A depending on what component is identified as being plugged into jack 112 and/or jack 111 to detect failures of different or multiple components.

Next, headset 116 may be any component that can be coupled to and used in conjunction with device 100, such as a headset including audio speakers, earphones, headphones, noise cancellation, a video display, microphone, or combinations of functionality thereof. The electronic coupling between signal contact 124*a* and contact M may be a wired or wireless electronic connection or attachment (e.g., circuit 129A is not used here). For example, a wireless transmission system may exist between contact 124*a* and contact M, such as a transmission system transmitting audio signals, current, and voltage levels described herein.

Device 100 may be specially constructed for the purposes described herein, or it may comprise or be part of a computer (e.g., portable, such as a laptop, tablet or hand held computer; or stationary, such as a desktop computer), mobile device, telephone or cellular telephone specially configured by a computer program stored in a storage medium. Such a computer program (e.g., program instructions) may be stored in a machine (e.g. computer) readable non-volatile storage medium or memory, such as, a type of disk including floppy disks, optical disks, CD-ROMs, and magnetic-optical disks, read-only memories (ROMs), erasable programmable ROMs (EPROMs), electrically erasable programmable ROMs (EEPROMs), magnetic or optical cards, magnetic disk storage media, optical storage media, flash memory devices, or any type of media suitable for storing electronic instructions. Device 100 may also include a processor coupled to the storage medium to execute the stored instructions. The processor may also be coupled to a volatile memory (e.g., RAM) into which the instructions are loaded from the storage memory (e.g., non-volatile memory) during execution by the processor. The processor and memory(s) may be coupled to circuitry 129A and/or 129B, and/or control unit 130. In some cases, the processor may include control unit 130.

At least certain embodiments of device 100 may be part of a mobile device, telephone or cellular telephone, which may include a media processing system to present the media, a storage device to store the media and may further include a radio frequency (RF) transceiver (e.g., an RF transceiver for a cellular telephone) coupled with an antenna system and the media processing system, computer, mobile device, telephone or cellular telephone. In certain embodiments, media stored on a remote storage device may be transmitted to the media player through the RF transceiver. The media may be, for example, one or more of music or other audio, still pictures, or motion pictures. For example, these embodiments may be part of a mobile telephone which includes the functionality of one or more: media players (music and/or video media), entertainment systems, personal digital assistants (PDAs), general purpose computer systems, mobile device, Internet capable mobile device, special purpose computer systems, an embedded device within another device, or other types of data processing systems or devices (e.g., an iPhone from Apple Inc. of Cupertino, Calif.).

The processes, instructions, and/or circuitry described herein may be designed and/or sold by handset manufacturers, such as manufacturers of a "source device" or "host device" that can detect headset or microphone circuitry failure as described herein. They may also be designed and/or sold by headset manufacturers, such as manufacturers of an audio headset or other headset having a microphone of a "headset" or "headphone" device that can detect headset or microphone circuitry failure as described herein.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A mobile device comprising:

a network interface to enable a failure notification be sent from the mobile device to a remote supply management system; and a microphone failure detection circuit to detect a failure of a microphone circuit of a headset coupled to the mobile device by measuring a change in at least one of a microphone bias line signal or a microphone bias line temperature signal, and then signal that a failure notification be transmitted to the remote supply management system using the network interface, wherein the microphone failure detection circuit is configured to compare the measured microphone bias line signal or the microphone bias line temperature signal to a first threshold to detect a predicted future failure of the headset, and to a second threshold to detect a current failure of the headset; and wherein the failure notification refers to a predicted future failure or a current failure of the headset.

2. The mobile device of claim 1, further comprising:

a direct current (DC) bias signal circuit operable to provide a DC bias signal to the microphone bias line.

3. The mobile device of claim 1, wherein upon detecting the failure, the microphone failure detection circuit is operable to signal a controller of the mobile device to establish a data connection with, and then transmit the failure notification to the remote supply management system using the network interface.

4. The mobile device of claim 3, wherein the microphone failure detection circuit comprises a comparator circuit to compare the measured microphone bias line signal or the microphone bias line temperature signal to a first threshold to detect a predicted future failure of the headset, and to a second threshold to detect a current failure of the headset.

5. The device of claim 1, wherein the network interface can establish one of a WiFi connection, a GSM data connection, and a computer peripheral bus connection.

6. The device of claim 1, wherein the failure notification includes identification of an owner of the mobile device and indicates to the remote supply management system to send another headset to the owner of the mobile device.

7. The mobile device of claim 1, further comprising:

sampling the microphone bias line signal over a period of time;

determining an average value for the microphone bias line signal; and measuring the change based on the average value of the microphone bias line signal.

8. The mobile device of claim 1, wherein the failure notification identifies a level or scale of the predicted future failure or the current failure of the headset.

9. A headset to be connected to a mobile device, the headset comprising:

a microphone bias line;

a microphone circuit coupled to the bias line; and a failure detection circuit coupled to the microphone circuit and operable to detect a failure of the microphone circuit, the failure detection circuit to measure a change in at least one of a microphone bias signal or a microphone bias line temperature signal of the headset, and then signal that a failure notification be transmitted to a remote supply management system using a network interface, wherein the failure detection circuit is configured to compare the measured microphone bias signal or the microphone bias line temperature signal to a first threshold to detect a predicted future failure of the headset, and to a second threshold to detect a current failure of the headset; and wherein the failure signal is a predicted future failure or a current failure of the headset.

10. The headset of claim 9, wherein the headset includes a cable having a plug connector to insert into a jack connector of a mobile device, earphones, a microphone electronic circuit interfaced between a microphone power contact and a ground contact of the plug connector; wherein the headset is operable to receive from the mobile device, a DC bias signal on the microphone bias line of the headset through a microphone bias power contact of the plug connector; and wherein the failure detection circuit is operable to detect a failure anywhere in a signal path between a microphone bias power contact and a ground contact of the plug connector.

11. The headset of claim 9, wherein the failure detection circuit is operable to signal a failure to a mobile device to cause the mobile device to transmit the failure notification.

12. The headset of claim 9, wherein the failure detection circuit is operable to detect a drop in voltage of the microphone bias signal below a first threshold and above a second threshold, and then to signal a predicted future failure of the headset in the failure notification.

13. The headset of claim 9, wherein upon detecting the failure, the failure detection circuit is operable to transmit a failure signal to a controller of a mobile device.

14. The headset of claim 13, wherein the failure detection circuit comprises a comparator circuit to compare the measured microphone bias signal or the microphone bias line temperature signal to a first threshold to detect a predicted future failure of the headset, and to a second threshold to detect a current failure of the headset.

15. A method comprising:

detecting a failure of a headset microphone circuit based on a measured change in a microphone bias signal or a measured microphone bias line temperature signal, wherein detecting comprises comparing the measured microphone bias signal or the microphone bias line temperature signal to a first threshold to detect a predicted future failure of the headset, and to a second threshold to detect a current failure of the headset;

establishing a data connection with a remote supply management system; and transmitting a failure notification to the remote supply management system, wherein the failure notification refers to a predicted future failure or a current failure of the headset.

16. The method of claim 15, wherein detecting detects a failure anywhere in a signal path between a microphone bias power contact and a ground contact of the plug.

17. The method of claim 15, wherein the failure notification includes identification of an owner of the mobile device and indicates to the remote supply management system to send another headset to the owner of the mobile device.

18. The method of claim 15 further comprising:

sampling the microphone bias line signal;

determining an average value for the microphone bias line signal; and measuring the change based on the average value of the microphone bias line signal.

19. The method of claim 15, wherein the failure notification identifies a level or scale of the predicted future failure or the current failure of the headset.

* * * * *